United States Patent [19]

Ishimoto

[11] Patent Number: 4,705,487

[45] Date of Patent: Nov. 10, 1987

[54] MOVABLE TOY AUTOMATICALLY SWINGABLE BETWEEN AN UP POSITION AND A DOWN POSITION

[75] Inventor: Zenichi Ishimoto, Tokyo, Japan

[73] Assignee: Nikko Co., Ltd., Tokyo, Japan

[21] Appl. No.: 771,651

[22] Filed: Sep. 3, 1985

[30] Foreign Application Priority Data

Jan. 16, 1985 [JP] Japan ..... 60-4087

[51] Int. Cl.[4] ..... A63H 11/10; A63H 17/00; A63H 30/04

[52] U.S. Cl. ..... 446/290; 446/443; 446/456; 446/462; 446/469

[58] Field of Search ..... 446/289, 290, 291, 324, 446/335, 396, 443, 454, 456, 462, 463, 352, 353, 354, 469

[56] References Cited

U.S. PATENT DOCUMENTS

| | | | |
|---|---|---|---|
| 3,500,577 | 3/1970 | Bart | 446/324 |
| 3,728,815 | 4/1973 | Tomiyama | 446/291 |
| 4,051,623 | 10/1977 | Ogawa | 446/290 |

FOREIGN PATENT DOCUMENTS

| | | | |
|---|---|---|---|
| 57-45885 | 3/1982 | Japan . | |
| 59-174181 | 10/1984 | Japan . | |
| 59-222181 | 12/1984 | Japan | 446/289 |

*Primary Examiner*—Richard T. Stouffer
*Attorney, Agent, or Firm*—Sandler & Greenblum

[57] ABSTRACT

A movable toy which automatically swings between an up position and a down position is disclosed, which includes an elongated toy body, a pair of driving wheels arranged at a bottom of the toy body, a pair of arms swingable from their vertical position to their forward horizontal position, a differential gear having an output shaft for forming a swing shaft of the arms, a driving motor and a gear train.

10 Claims, 8 Drawing Figures

MOVABLE TOY AUTOMATICALLY SWINGABLE BETWEEN AN UP POSITION AND A DOWN POSITION

FIELD OF THE INVENTION

This invention relates to a movable toy, more particularly to a remote control movable toy which can swing between an up position and a down position automatically during its movement.

BACKGROUND OF THE INVENTION

Various remote control movable toys of robot type have been proposed, which may change the direction of movement and the action of arms.

However, such conventional movable toys capable of various movements are complicated in their control mechanism and have high manufacturing costs. On the other hand, the toy loses a considerable part of its appeal if the movement thereof is reduced in order to cut the manufacturing costs.

Accordingly, an object of the present invention is to provide a movable toy which has a novel function of automatically swinging between up and down positions, which is simple in construction or mechanism and may perform a smooth movement of automatically swinging between up and down positions by means of a combination of gears.

SUMMARY OF THE INVENTION

In view of the forgoing, the invention provides a toy capable of automatically swinging between up and down positions, which comprises a vertically elongated toy body, a pair of driving wheels arranged at a bottom of the toy body and slightly protruded from its front face, a pair of arms arranged at an upper part of the toy body and swingable from their upper vertical position to their forward horizontal position, and a differential gear having an output shaft for forming a swing shaft of the arms, said differential gear having two other differential shafts rotatable oppositely to each other, as well as a driving motor and a gear train, said differential shafts being connected through said gear train to an output shaft of said driving motor and to an axlw of said driving wheels, thereby to move in a standing-up state with the arms being kept horizontally.

In the movable toy as described above, the arms and the driving wheels may be connected to the differential gear and the gear train so as to move the driving wheels forward when the arms are kept horizontally and to automatically swing to up position when the toy starts its forward movement.

Further, in such movable toy, the arms and the driving wheels are connected to the differential gear and the gear train so as to move the driving wheels backward when the arms are kept vertically, and to allow the toy to swing to down position with the arms at their front ends being contacted with a ground when the toy starts its backward movement.

Preferably, the arms and the driving wheels may be connected switchably so as to automatically swing to up position upon the backward movement of the toy body and to automatically swing to down position upon the forward movement of the toy body.

For better understanding, the invention will be described in more detail with reference to the accompanying drawings.

BRIEF DESCRIPTION OF THE INVENTION

FIGS. 6 to 8 illustrate another embodiments of the movable toy according to the invention, wherein FIG. 6 is a side view of the movable toy in a usual running condition and FIG. 7 is a side view of the movable toy in a standing-up position; and FIG. 8 is a front view of the movable toy shown in FIG. 7.

PREFERRED EMBODIMENTS OF THE INVENTION

Figure 1:
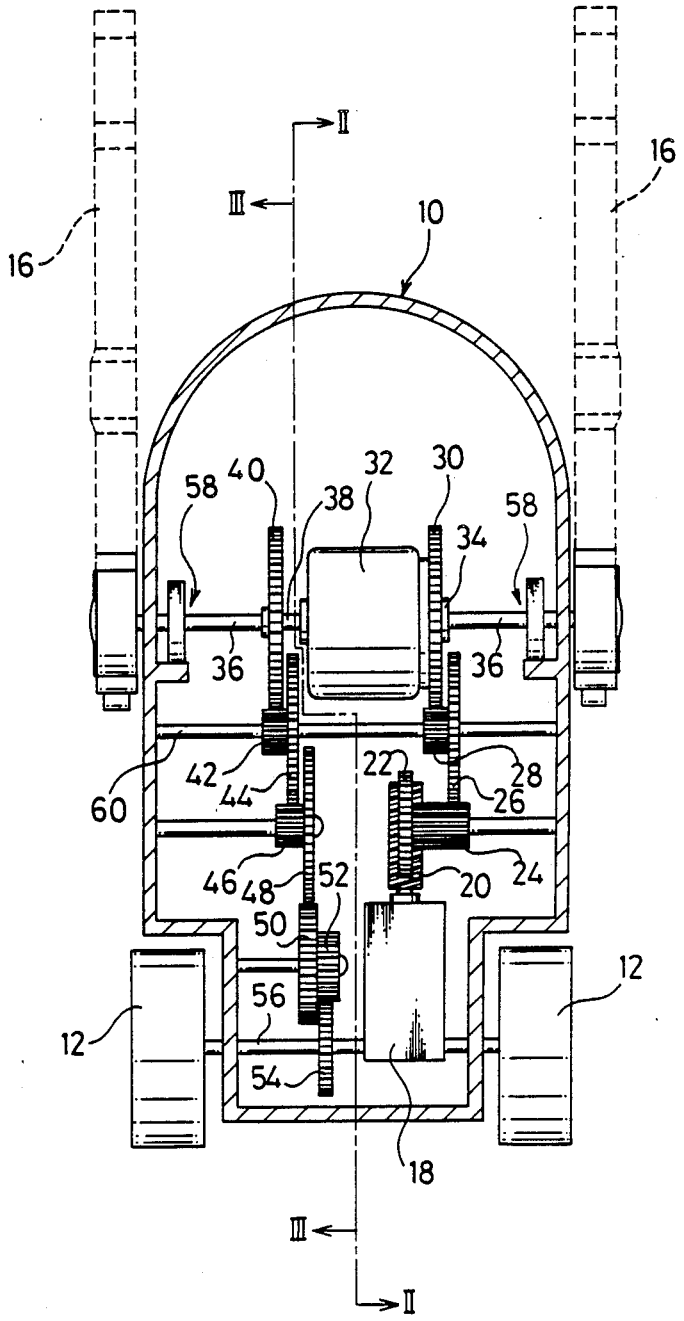
FIG. 1 is a sectional back view of one embodiment of the movable toy according to the invention.
Figure 3:
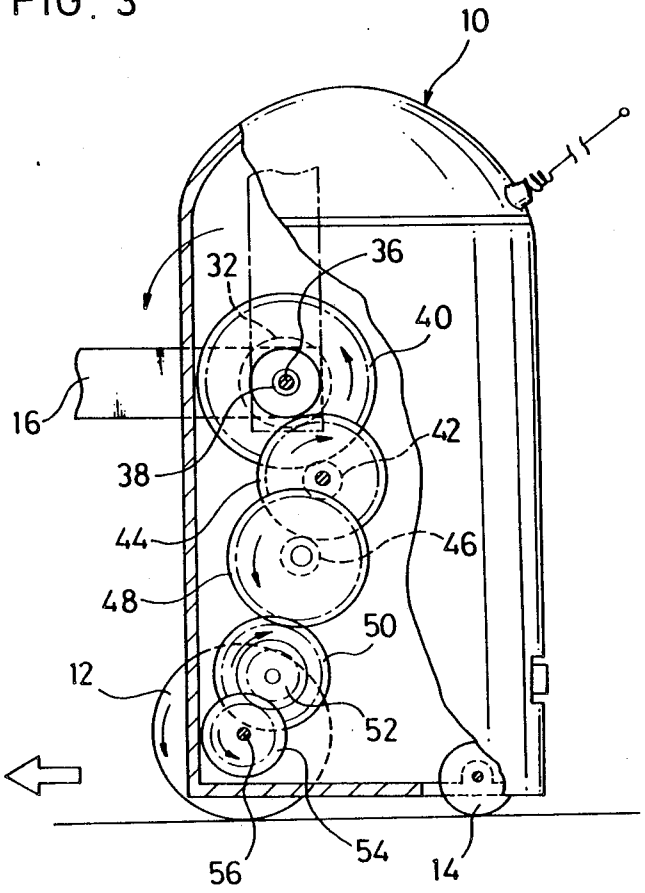
FIG. 3 is a sectional view of the movable toy taken along the line III—III in FIG. 1.
Figure 2:
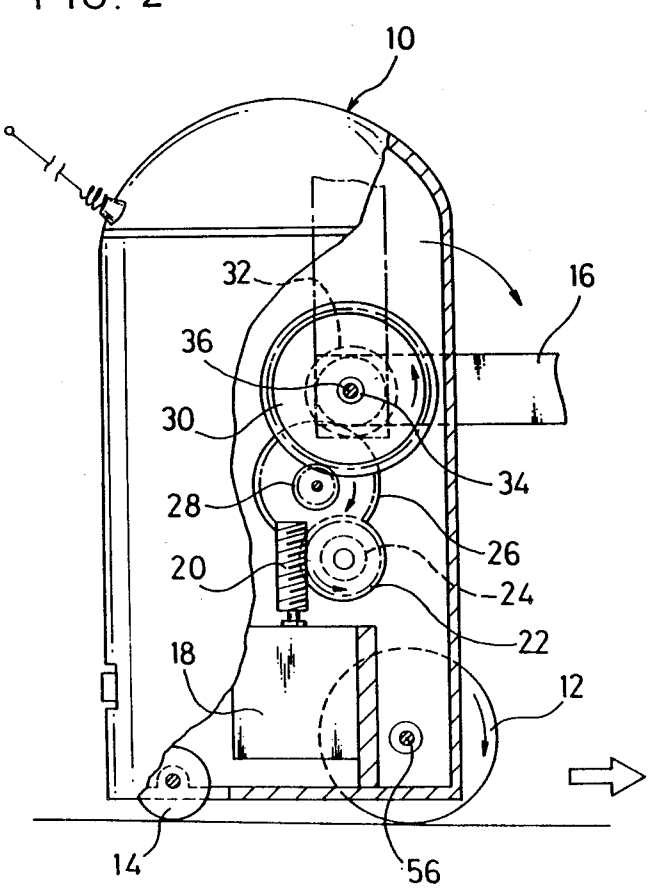
FIG. 2 is a sectional view of the movable toy taken along the line II—II in FIG. 1.

FIGS. 1 to 3 illustrate one embodiment of the toy capable of automatically swinging between up and down positions according to the invention with its main mechanism. Namely, FIG. 1 shows a back side of the toy body 10. FIG. 2 is a partially sectional view of the toy body taken along the line II—II in FIG. 1 while FIG. 3 is also a partially sectional view of the toy body taken along the line III—III in FIG. 1.

In the movable toy according to the invention, a toy body 10 is vertically elongated in its up position, which at its bottom is provided symmetrically with a pair of driving wheels 12, 12 slightly protruded from a front face of the toy body 10, while at its rear is provided with an auxiliary wheel 14. At an upper part of the toy body 10 is swingably arranged a pair of arms 16, 16 corresponding to the driving wheels 12, 12. The arms 16, 16 are swingable in the angle of about 90 degrees from their upper vertical position to their forward horizontal position.

Now, a driving mechanism for the driving wheels 12, 12 and the swingable arms 16, 16 will be described in detail. In FIGS. 1 and 2, a reference numeral 18 represents a driving motor which has an output shaft connected to a worm shaft 20. A rotary movement of the worm shaft 20 is transmitted sequentially from a first large gear 22 through a first small gear 24, a second large gear 26 and a second small gear 28 to a third gear 30. The last gear 30 is connected to a first input shaft 34 of a differential gear 32 which has a first reversing output shaft 36 connected at its either end to the arms 16, 16 and a second reversing output shaft 38 connected to a gear train for driving the wheels 12, 12. To the second reversing output shaft 38 is connected a fourth gear 40, a rotary movement of which is transmitted sequentially from a fifth small gear 42 through a fifth large gear 44, a sixth small gear 46, a sixth large gear 48, a seventh large gear 50, a seventh small gear 52 and an eighth gear 54 to an axle 56 directly connected to the driving wheels 12, 12. The second gears 26, 28 and the fifth gears 42, 44 are supported to a common shaft 60 for ensuring smooth transmission of the rotary movement of the differential gear 32 during its racing.

The movable toy of this embodiment may contain a radio-receiver and a power battery (not shown) for receiving operational signals from an external radio-transmitter, thereby to control an ON-OFF operation and a direction-switching operation of the driving motor 18.

The operation of the movable toy will now be described hereinbelow.

When the toy body 10 is moved forward as shown with arrows in FIGS. 2 and 3, the rotary movement is transmitted from the worm shaft 20 to the differential gear 32. Thus, the rotary movement from the first reversing output shaft 36 allows the arms 16, 16 to swing up to their horizontal position. The swinging movement of the arms 16, 16 is limited by stoppers 58, 58 arranged at a portion of the toy body 10 and a portion of the first reversing output shaft 36. Discontinuation of the swinging movement of the arms 16, 16 allows the differential gear 32 to race. On the other hand, the rotary movement from the second reversing output shaft 38 is transmitted to each gear, as shown in FIG. 3, for moving the driving wheels 12, 12 forward. The moving state and the operational state of the toy body 10 is shown in FIG. 4.

Figure 5:
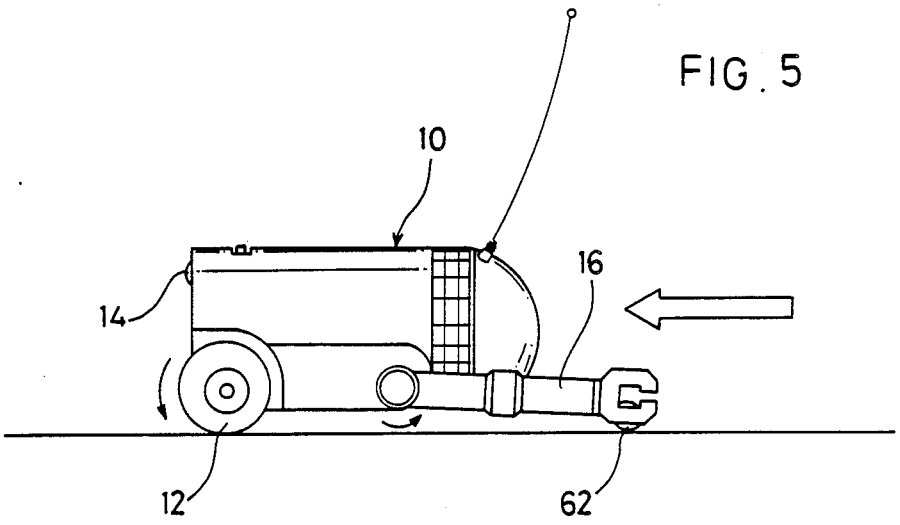

When the toy body 10 is moved backward, the driving motor 18 is reversed to rotate each output shaft of the gears and the differential gears, as shown in FIGS. 2 and 3, in the opposite direction. As a result, the toy body 10 swings to down position and moves backward through operation of the arms 16, 16 as shown in FIG. 5. In this case, the arms 16, 16 at their front ends are contacted to the ground, so that each of the arms at its front end is preferably provided with an auxiliary wheel 62 for ensuring the smooth backward movement, as shown in FIG. 5.

Figure 4:
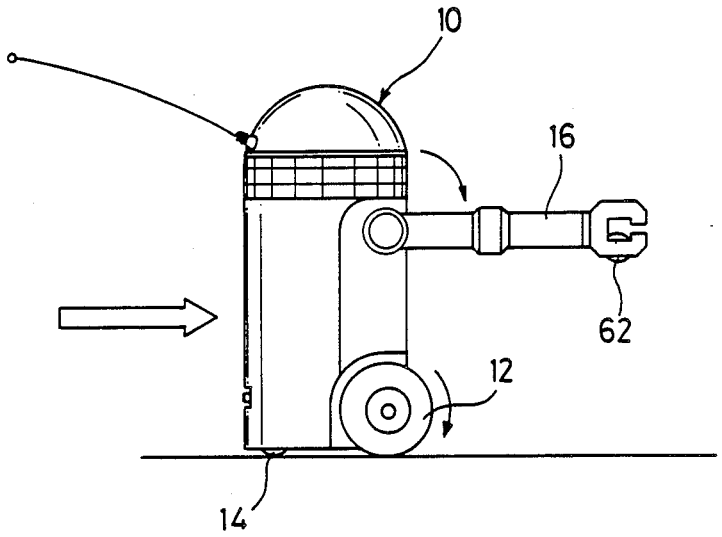
FIGS. 4 and 5 are pictorial views for illustrating actions of the movable toy according to the invention.

If the moving direction of the toy body 10 is reversed from the down position in FIG. 5 to the up position in FIG. 4, the arms and the driving wheels move in the direction as shown in FIGS. 2 and 3, so that the arms 16, 16 may move gradually toward the driving wheels 12, 12 to allow the toy body 10 to swing automatically to up position and move forward in the standing-up position.

In the embodiment as described hereinabove the toy body 10 is moved forward with its standing-up position and moved backward in its down position. If desired, however, arrangement of additional gears for transmitting the rotary movement to the driving wheels 12, 12 may allow the opposite movement, so that the toy body 10 moves forward with its down (or fallen) position and backward with its standing-up (or risen) position.

Figure 6:
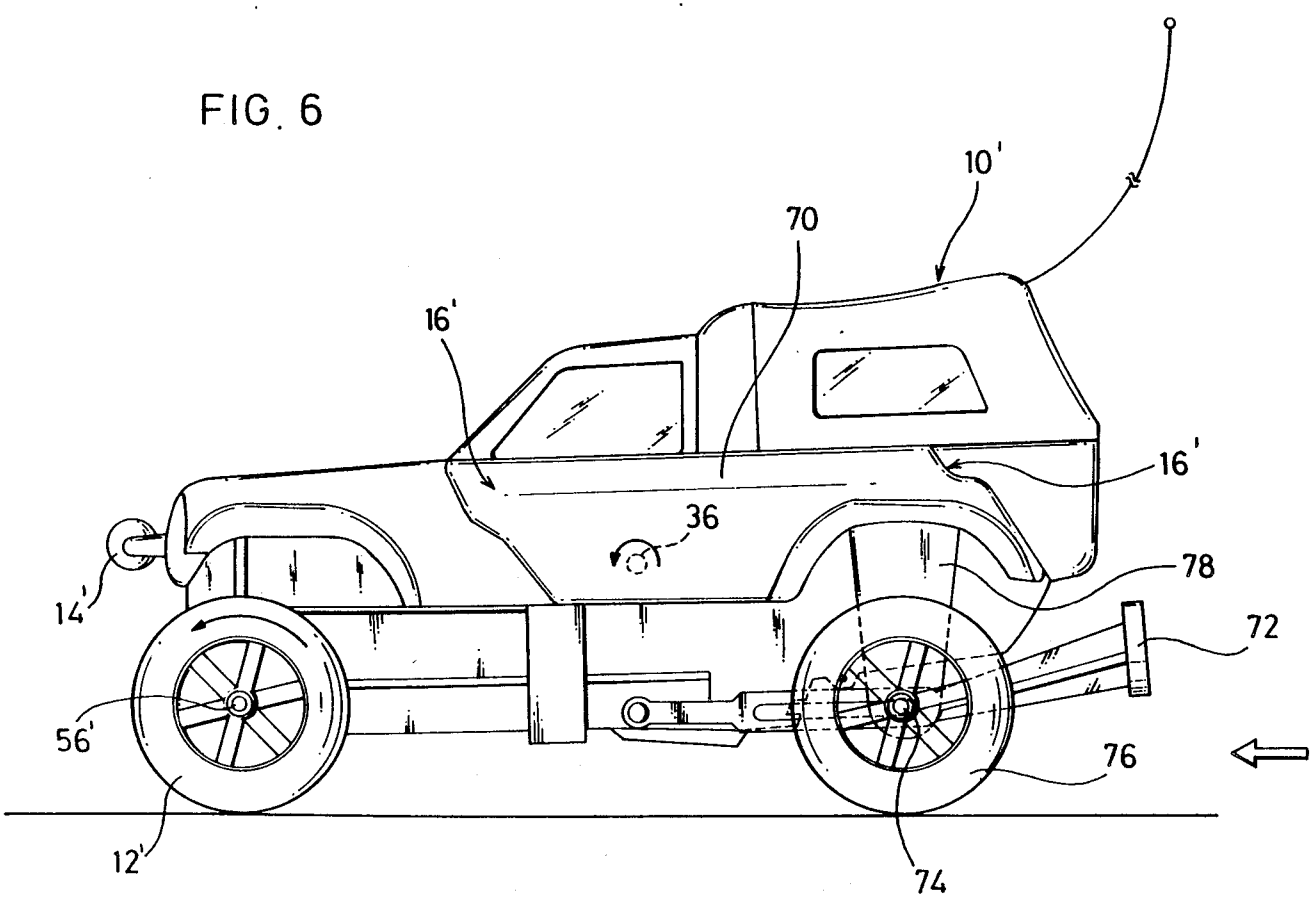
Figure 7:
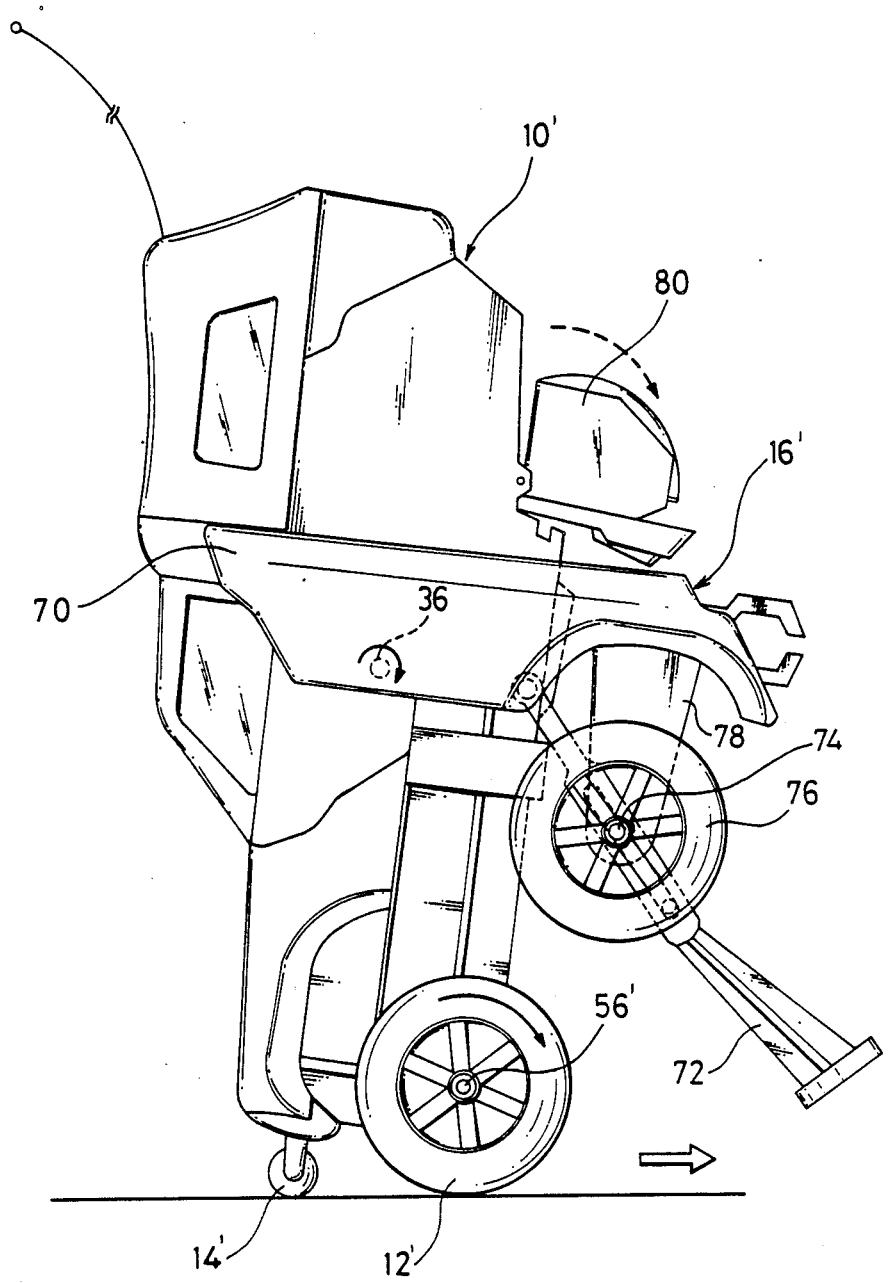
Figure 8:
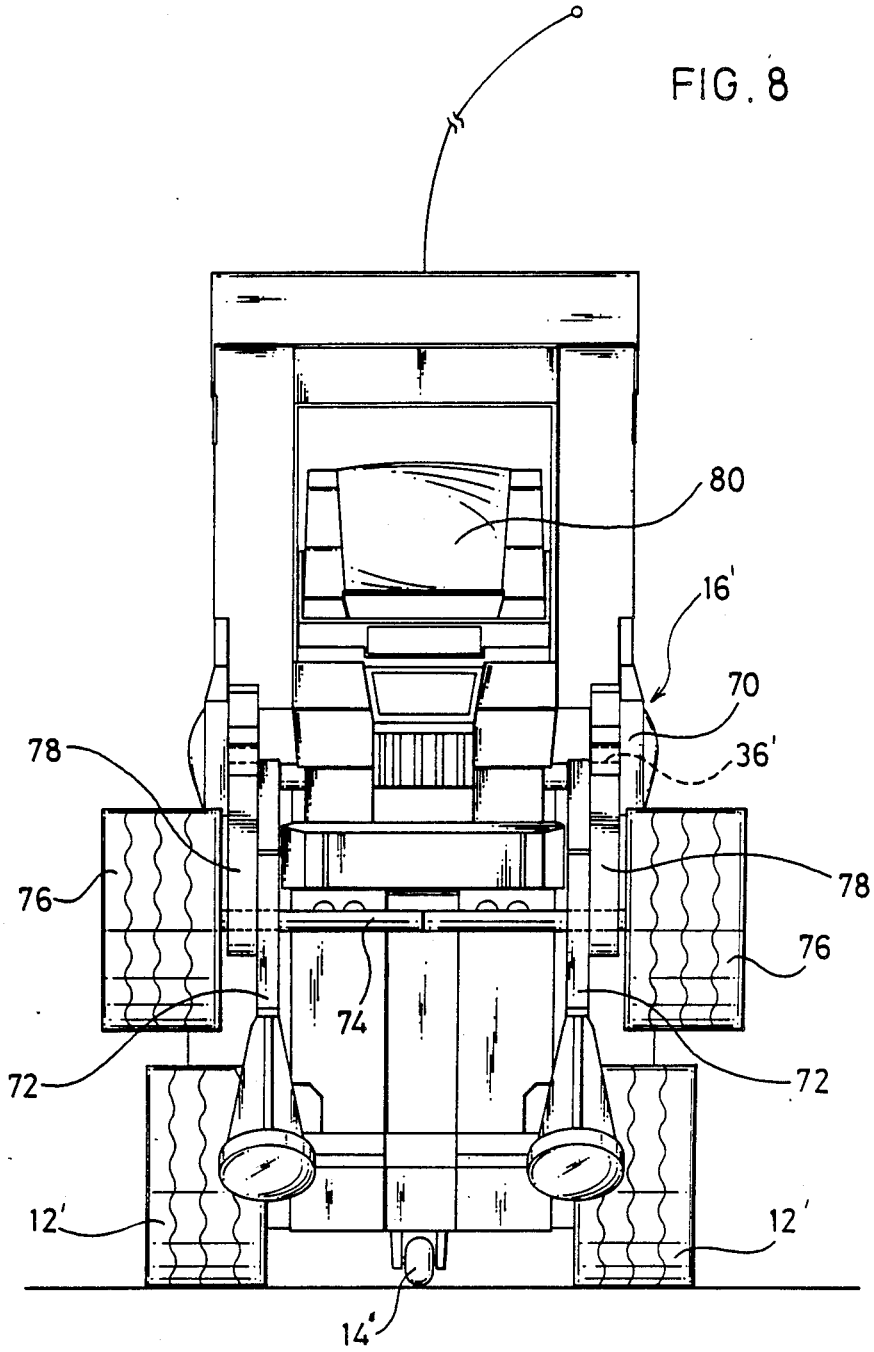

FIGS. 6, 7 and 8 show another embodiment of the movable toy capable of automatically swinging between up and down positions according to the invention, in which the movable toy is in the form of a toy car, a portion of which is transformed upon its standing-up position into a robot. The internal driving mechanism therefor is identical to the embodiment as shown in FIGS. 1 to 3 and thus may be omitted. For convenience of illustrating the essential reversing driving shaft, its components are shown with the same references as in FIGS. 1 to 3.

FIG. 6 shows a forward moving position of the toy car in this embodiment, in which front wheels 12', 12' serve as driving wheels above which is arranged an auxiliary wheel 14', and in which both side walls of a car body and rear wheels are formed as swingable arms 16', 16'. Each swingable arm 16' comprises a swingable side wall 70 connected to the first reversing output shaft 36', a swingable rod 72 extending below and in parallel to the side wall 70 and being pivoted at its one end to the car body 10', and a rear wheel 76 connected to an axle 74 which in turn is movably fitted to a middle portion of the swingable rod 72. The axle 74 is pivoted to a supporting piece 78 provided on a portion of the side wall 70 which may be rotated integrally with the swingable rod 72. Thus, when the front wheel 12' connected to the axle 56' moves forward, the first reversing output shaft 36' rotates in the direction as shown with an arrow in FIG. 6, thereby to move the toy car forward.

When the front wheel 12' is reversed as shown in FIG. 7, the first reversing output shaft 36' is also reversed, thereby to swing the side wall 70 and the swingable rod 72 (namely, the swingable arm 16') for allowing to toy car to stand up and to make the auxiliary wheel 14' to be contacted to the ground for keeping balance while moving backward. In this case, the car body 10' at its rear bottom is provided with a lamp-receiving head 80 which may be opened or closed by the swingable rod 72 of the arm 16'. When the car body 10' stands up as shown in FIG. 7, the lamp-receiving head 80 is opened to expose a lamp which may be switched on and off. Thus, the toy car may be metamorphosed into a robot, resulting in a very interesting movable toy (FIG. 8).

In accordance with the invention, the transmission of the rotary movement to the driving wheels and of the swinging movement to the arms may be reversed by combination of the plural gears with the differential gear, so that the moving direction may be accompanied with the up or down swinging movement, resulting in a very amusing movable toy.

Particularly, the main portion of the movable toy according to the invention consists of the gear train. Thus, plastic may be used to form the gear train for manufacturing the movable toy of a light-weight and in a compact form and at a low cost. Further, any operational technique, such as a radio-controlling system utilizing a radio-receiver and transmitter or a remote-controlling system utilizing an optic fiber and a lead wire may be used to operate the movable toy according to the invention.

Although the invention has been described hereinabove with the preferred embodiments, the invention is not limited thereto and may be embodied with various modifications without departing from the spirit and scope of the invention.

What is claimed is:

1. A robot toy movable on a support surface and capable of automatically swinging between an up position and a down position, said toy comprising:

(a) a vertically elongated toy body comprising an upper portion and a lower portion each comprising a front section and a rear section, wherein the height of said toy body is more than the width thereof;

(b) a plurality of driving wheels mounted on said front section of said lower portion of said toy body such that said driving wheels protrude beyond a front face of said toy;

(c) a plurality of arms mounted on said front section of said upper portion of said toy body, each of said arms being swingable between a substantialy vertical position and a substantially horizontal position, wherein each of said arms comprises an auxiliary wheel mounted adjacent the free end thereof; and (d) a support wheel mounted in the center of said rear section of said lower portion, wherein when said toy is positioned on said support surface and moves forwardly in said up position with said arms being in said substantially horizontal position, said elongated toy body is supported on said support surface by said driving wheels and said support wheel, wherein when said toy is positioned on said support surface and moves rearwardly in said down position with said arms being substantially horizontal to said support surface, said elongated toy body is supported on said support surface by said driving wheels and said auxiliary wheel of each of said arms.

2. A toy car movable on a support surface and capable of automatically swinging between an up position and a down position, said toy car comprising:

(a) an elongated car body comprising a front portion and a rear portion;

(b) a plurality of driving wheels mounted on said front portion of said car body such that said driving wheels protrude beyond a front face of said car;

(c) a plurality of arms mounted on said rear portion of said car body, each of said arms comprising a support wheel and being swingable between a substantially vertical position and a substantially horizontal position; and (d) an auxiliary wheel mounted above and adjacent said driving wheels on said front portion of said car body;

wherein when said toy car is positioned on said support surface in said up position, said car body is supported on said support surface by said auxiliary wheel and said driving wheels, and said support wheel of each of said arms is off said support surface in the air, wherein when said toy car is positioned on said support surface in said down portion, said car body is supported on said support surface by said driving wheels and said support wheel of each of said arms.

3. A robot toy movable on a support surface and capable of automatically swinging between an up position and a down position, said toy comprising:

(a) a vertically elongated toy body comprising an upper portion and a lower portion;

(b) a plurality of driving wheels mounted on said lower portion of said toy body such that said driving wheels protrude beyond a front face of said toy;

(c) a plurality of arms mounted on said upper portion of said toy body, each of said arms being swingable between a substantially vertical position and a substantially horizontal position, wherein each of said arms comprises an auxiliary wheel mounted adjacent the free end thereof; and (d) a differential gear having an output shaft which comprises a swing shaft for each of said arms, said differential gear comprising at least two differential shafts rotatable in opposite directions to each other, a driving motor, and a gear train, one of said differential shafts being connected through a first portion of said gear train to an output shaft of said driving motor and the other of said differential shafts being connected through a second portion of said gear train to an axle connected with said driving wheels, wherein said toy moves in an upright position with each of said arms being in said substantially horizontal position.

4. A movable toy according to claim 3, wherein the arms and the driving wheels are connected to the differential gear and the gear train, so as to rotate the driving wheels forwardly when the arms are in said horizontal position whereby said toy automatically swings to said vertical position when the toy starts its forward movement.

5. A movable toy according to claim 3, wherein the arms and the driving wheels are connected to the differential gear and the gear train, so as to rotate the driving wheels backwardly when the arms are in said vertical position, and to allow the toy to swing down to said down position with the arms at their front ends contacting the support surface when the toy is positioned on the support surface and starts its backward movement.

6. A movable toy according to claim 3, wherein the arms and the driving wheels are connected such that the toy automatically swings to said up position upon the forward movement of the toy body and automatically swings to said down position upon the backward movement of the toy body.

7. A toy car movable on a support surface and capable of automatically swinging between an up position and a down position, said toy car comprising:

(a) an elongated car body comprising a front portion and a rear portion;

(b) a plurality of driving wheels mounted on said front portion of said car body such that said driving wheels protrude beyond a front face of said car;

(c) a plurality of arms mounted on said rear portion of said car body, each of said arms being swingable between a substantiallly vertical position and a substantially horizontal position; and (d) a differential gear having an output shaft which comprises a swing shaft for each of said arms, said differential gear comprising at least two differential shafts rotatable in opposite directions to each other, a driving motor, and a gear train, one of said differential shafts being connected through a first portion of said gear train to an output shaft of said driving motor and the other of said differential shafts being connected through a second portion of said gear train to an axle connected with said driving wheels.

8. A movable toy car according to claim 7, further comprising an auxiliary wheel mounted above and adjacent said driving wheels for maintaining said up position, wherein each of said plurality of arms comprises a side wall of said rear portion of said car body, a swingable rod and a rear wheel, wherein each of said arms is coupled to said swing shaft.

9. A movable toy according to claim 8, wherein each of said rear wheels of said each swingable arm is connected to a further axle which is movably fitted to a portion of said swingable rod pivotally connected at its one end to the car body, said further axle being pivoted to a supporting piece provided on the side wall which is connected to said swing shaft.

10. A movable toy according to claim 9, wherein the car body at its rear bottom is provided with a lamp-receiving head capable of being opened or closed by the axle connected to the rear wheels.

* * * * *